US005765628A

United States Patent [19]

Weber

[11] Patent Number: 5,765,628

[45] Date of Patent: Jun. 16, 1998

[54] FREEZE TOLERANT ROTATING FLUID MANAGEMENT DEVICE

[75] Inventor: Kent Weber, Rockford, Ill.

[73] Assignee: Sundstrand Corporation, Rockford, Ill.

[21] Appl. No.: 823,947

[22] Filed: Apr. 8, 1997

[51] Int. Cl.[6] ..... F28D 15/00

[52] U.S. Cl. ..... 165/104.25; 165/86

[58] Field of Search ..... 165/104.25, 104.22, 165/86

[56] References Cited

U.S. PATENT DOCUMENTS

| | | | |
|---|---|---|---|
| 3,151,669 | 10/1964 | Quenneville | 165/86 X |
| 3,999,400 | 12/1976 | Gray | 165/86 X |
| 4,603,732 | 8/1986 | Niggemann | 165/104.25 X |
| 4,875,826 | 10/1989 | Readman | 415/89 |
| 4,984,625 | 1/1991 | Lichtfuss | 165/104.25 |
| 5,003,823 | 4/1991 | Rice | 73/293 |
| 5,117,901 | 6/1992 | Cullimore | 165/86 X |
| 5,201,196 | 4/1993 | Faghri | 165/86 X |

*Primary Examiner*—John Rivell
*Assistant Examiner*—Christopher Atkinson
*Attorney, Agent, or Firm*—Wood, Phillips, Van Santen, Clark & Mortimer

[57] ABSTRACT

The use of a working fluid that is subject to freezing is achieved in a fluid system including a rotating fluid management device (RFMD) (10) and a pair of fluid flow loops (22, 27) connected to the RFMD (10) and arranged so that the inventory of working fluid in the system drains to the RFMD (10) when the system is not operating. The RFMD (10) includes a housing (32) having an inlet port (60, 64), a first outlet port (56), a second outlet port (62), a reservoir (34) mounted on the housing (32) for rotation about a vertical axis (38), a return (92, 93) for directing working fluid from the inlet port (60, 64) to the reservoir (34), a pitot tube (116) fixed to the housing (32) and extending to adjacent radially outer location (118) in the reservoir (34) for directing liquid phase working fluid from the reservoir to the first outlet (62), and a vent (121) located radially inward from the radially outer location (118) for directing gas phase working fluid from the reservoir (34) to the second outlet port (56). The reservoir (34) includes a storage volume (84) sufficient to store the entire inventory of working fluid in the system when the system is not operating. The storage volume (84) is defined by an upwardly opening, concave surface of revolution (86) centered on the vertical axis (38).

10 Claims, 2 Drawing Sheets

FREEZE TOLERANT ROTATING FLUID MANAGEMENT DEVICE

FIELD OF THE INVENTION

This invention relates to apparatus for managing a heat exchange fluid that can be in the vapor, liquid or solid phases.

BACKGROUND OF THE INVENTION

Two-phase working fluids are commonly employed in thermal management systems where low pumping power and compact heat exchangers are desirable. Such systems dissipate heat from a heat load by evaporating the working fluid and reject heat to a heat sink by condensing the working fluid. These systems often incorporate a rotating fluid management device (RFMD) to separate liquid phase working fluid from gas phase working fluid and to pump the separated phases through the system.

Water is a preferred working fluid where toxicity, thermal stability, flammability, or availability of the working fluids are concerns for the system. However, typical systems do not employ water or other working fluids having relatively high freezing points because of the risk of freezing when the system is in a non-operating mode and a cold environment. Freezing can damage the components of the system and can create difficulties in thawing all of the lines and components of the system before operating the system. The RFMD is one of the system components that is particularly susceptible to damage from freezing because the RFMD typically acts as a reservoir for a volume of the working fluid when the system is not operating. Because of these concerns, a working fluid having a freezing point below the minimum cold soak temperature of the system is usually selected. This, in turn, frequently rules out water as a working fluid in spite of its many advantages.

Thus, there is a need for an RFMD that allows the use of water for the working fluid in a two-phase thermal management system.

SUMMARY OF THE INVENTION

It is the principal object of the invention to provide a new and improved rotating fluid management device for a fluid system. More specifically, it is an object to provide a freeze tolerant rotating fluid management device for a thermal management system utilizing relatively high freezing point substances, such as water, as a working fluid.

These and other objects of the present invention are attained in a fluid system utilizing an inventory of working fluid that is subject to freezing when the system is not operating. The system includes a RFMD and a fluid flow loop connected to the RFMD and arranged so that the inventory of working fluid in the system drains to the RFMD when the system is not operating. A highly preferred embodiment of the RFMD includes a housing having an inlet port, a second outlet port, a second outlet port, a reservoir mounted on the housing for rotation about a vertical axis, a return for directing working fluid from the inlet port to the reservoir, a pitot tube fixed to the housing and extending to adjacent a radially outer location in the reservoir for directing liquid phase working fluid from the reservoir to the second outlet port, and a vent located radially inward from the radially outer location for directing working fluid from the reservoir to the first outlet port. The reservoir includes a storage volume sufficient to store the entire inventory of working fluid in the system when the system is not operating. The storage volume is defined by an upwardly opening, concave surface of revolution centered on the vertical axis.

DETAILED DESCRIPTION OF THE PREFERRED EMBODIMENT

Figure 1:
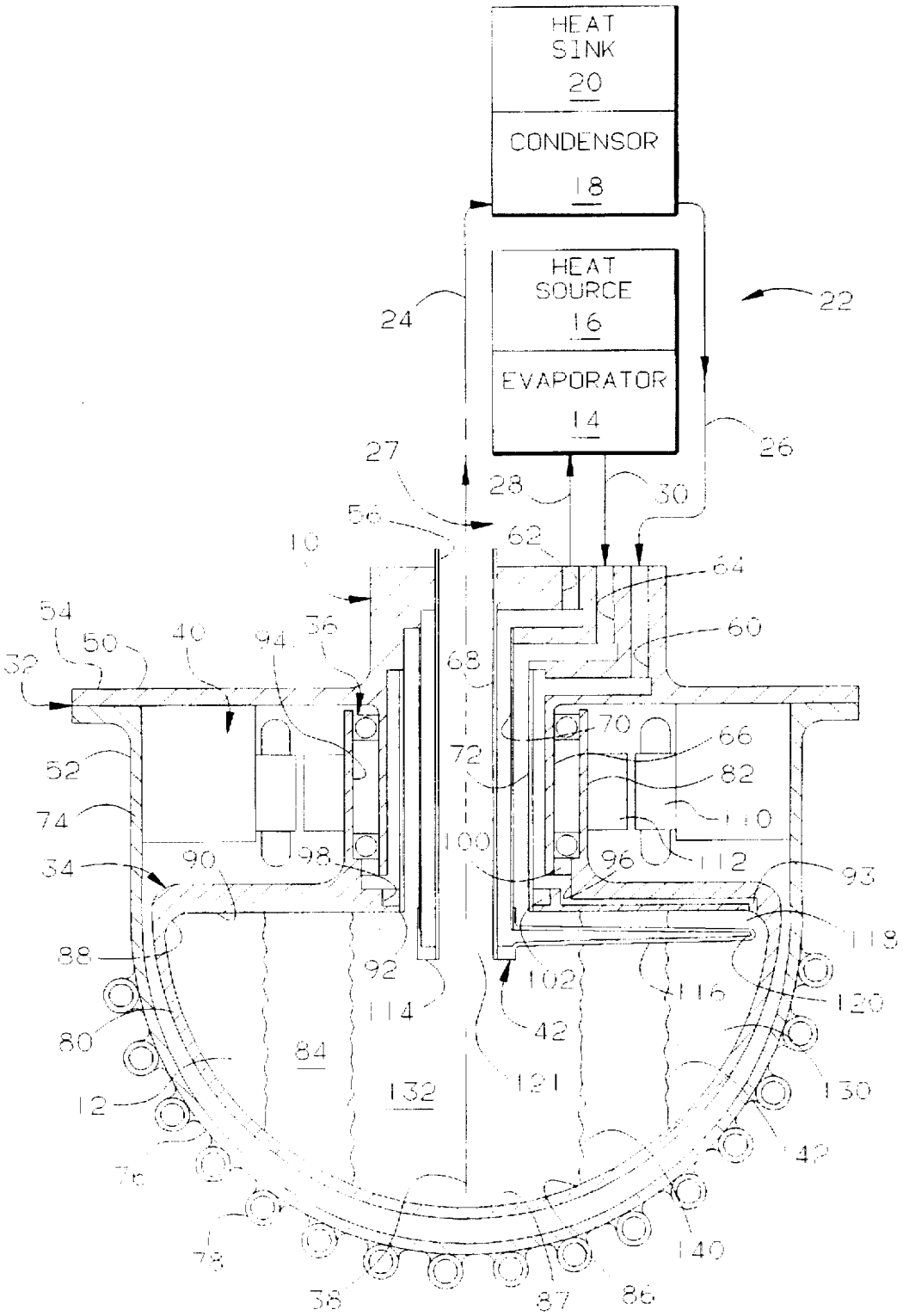
FIG. 1 is a diagrammatic illustration of a two-phase thermal management system including a RFMD embodying the present invention.
Figure 2:
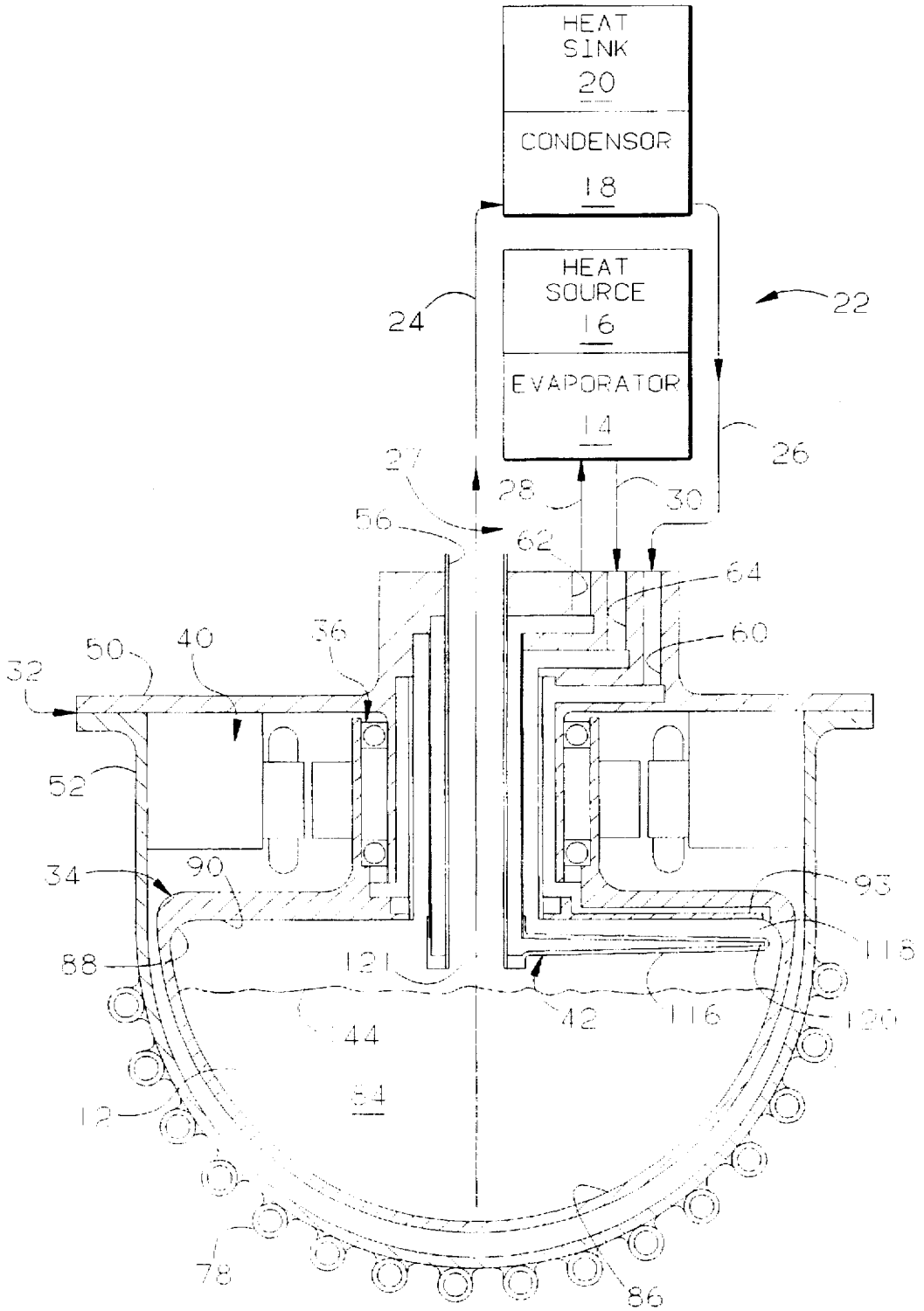
FIG. 2 is a diagrammatic illustration similar to FIG. 1 but showing the system and the RFMD in the non-operating mode.

With reference to FIGS. 1 and 2, an exemplary embodiment of a rotating fluid management device (RFMD) 10 made according to the invention is described and illustrated in connection with a two-phase thermal energy management system. However, it should be understood that the invention may find utility in other applications, and that no limitation to use with a two-phase thermal energy management system is intended except insofar as expressly stated in the appended claims.

As seen in FIG. 1, an exemplary embodiment of a rotating fluid management device 10 made according to the invention is incorporated in a two-phase thermal energy management system including a working fluid in the form of water 12; an evaporator 14 for transferring heat from a heat source 16 to the water 12; a condenser 18 for rejecting heat from the water 12 to a heat sink 20; a first fluid flow loop 22 defined by fluid lines or conduits 24, 26; and a second fluid flow loop 27 defined by fluid lines or conduits 28 and 30.

The RFMD 10 includes a two piece housing 32; a rotatable reservoir 34 for storing and pumping the water 12; means, shown in the form of a bearing assembly 36, for mounting the reservoir 34 to the housing 32 for rotation about a vertical axis 38; means, shown in the form of a motor assembly 40, for rotating the reservoir 34; and a pitot assembly 42 for directing liquid phase working fluid from the reservoir 34 to the second fluid flow loop 27.

The two piece housing 32 includes an upper housing 50 and a lower housing 52 that are connected by bolts (not shown) extending thru a flange joint 54. The upper housing 50 includes a first outlet port and conduit 56 connected to the fluid line 24 for directing gas phase water 12 to the condenser 18, an inlet port and conduit 60 connected to the fluid line 26 for directing liquid phase water 12 from the condenser 18 to the reservoir 34, a second outlet port and conduit 62 connected to the fluid line 28 for directing liquid phase water 12 from the reservoir 34 to the evaporator 14, and an inlet port and conduit 64 connected to the flow line 30 for directing liquid and gas phase (mixed phase) water 12 from the evaporator 14 to the reservoir 34. The upper housing 50 further includes a cylindrical, cantilever bearing post 66 for rotatably mounting the reservoir 34 through the bearing assembly 36. The upper housing 50 also includes three cylindrical tubes 68, 70 and 72 that define, in part, the ports and conduits 56, 60, 62 and 64. The lower housing 52 is defined by a cylindrical upper section 74 and a generally hemispherical lower section 76 that is shaped to substantially conform to the reservoir 34. The lower housing 52 further includes heating means, shown in the form of a plurality of heating elements or coils 78, for thawing the water 12 that is stored in the reservoir 34, as will be explained in detail below.

The reservoir 34 has a generally hemispherical shaped lower section 80 for storing and pumping the water 12, and a cylindrically shaped upper section 82 for mounting the reservoir 34 to the post 66 through the bearing assembly 36. The lower section 80 contains a storage volume 84 defined by an upwardly opening, concave surface of revolution 86 centered on the vertical axis 38. It should be appreciated that the terms concave and surface of revolution are used in their very broadest sense and include surfaces that define a plurality of straight line segments when sectioned. The surface 86 slopes upwardly and outwardly from a bottom-most area 87 of the surface. The surface 86 terminates at an annular intersection surface 88 that joins the surface 86 with a circular shaped planar surface 90 which connects the lower section 80 to the upper section 82 of the reservoir 34. The surface 90 is essentially perpendicular to the axis 38 and has a circular return opening 92. The lower section 80 also includes an return conduit and port 93 for pumping liquid phase water from the inlet conduit and port 60 to the storage volume 84. The upper section 82 includes a bearing bore defined by a stepped series of cylindrical surfaces 94, 96, and 98. The surface 94 receives the bearing assembly 36. A rotary seal 100 is provided between the surface 96 and the post 66 to seal the conduit 60. A rotary seal 102 is provided between the surface 98 and the tube 72 to seal the conduits 60 and 64.

The motor 50 may be of any conventional construction and includes a stator 110 fixed to the lower housing 52 and a rotor 112 fixed to the reservoir 34.

The pitot assembly 42 includes a manifold 114 that is in fluid communication with the annulus between the tubes 68, 70 and a pitot tube 116 that extends from the manifold 114 to a radially outer location 118 adjacent the radially outer-most portion of the surface 86. A tangential inlet 120 is provided in the pitot tube 116 at the radially outer location 118. The inlet 120 opens opposite the intended direction of rotation for the reservoir 34. Because the pitot assembly 42 is stationary, rotation of the reservoir 34 will cause ram like induction of the liquid phase water into the pitot tube 116. Together, the manifold 114 and the tube 68 define an outlet vent 121 for directing gas phase water 12 from the storage volume 84 to the outlet port 56.

In operation, the motor 40 rotatably drives the reservoir 34 about the axis 38 at a sufficiently rapid rate for centrifugal force to cause liquid phase water 12 to move radially outwardly against the surface 86 thereby defining an annular body of liquid phase water 130, as best seen in FIG. 1. The body 130 of water surrounds a central vapor core 132 occupied by gas phase water 12. Liquid phase water 12 forced by the rotation of the reservoir 34 into the inlet 120 flows through the pitot tube 116 and the manifold 114 to the conduit and port 62 where it is then delivered to the evaporator 14 through the line 28. The liquid phase water 12 is then at least partially evaporated in the evaporator 14 by heat rejected from the heat source 16. The water 12 then flows through the flow line 30 to the conduit and port 64 which directs the water 12 back into the storage volume 84 through the inlet opening 92. The water 12 is then separated into the liquid phase and the vapor phase by the rotation of the reservoir 34. The centrifugal force generated by the rotation of the reservoir 34 and the return conduit and port 93 forces liquid phase water 12 to flow from the line 26 and the conduit and port 60 to the storage volume 84. This creates a reduced pressure in the condenser 18 that draws gas phase water 12 from the vapor space 132 through the outlet 121, the conduit 56, and the line 24 to the condenser 18. The vapor phase water 12 is condensed to liquid phase water 2 by rejecting heat to the heat sink 20 associated with the condenser 18. The liquid phase water 12 is then drawn through the line 26 and the conduit in the port 60 by the rotation of the return conduit and port 93, which returns the liquid phase water 12 to the storage volume 84.

It should be understood that at startup the water 12 will have a starting liquid/vapor phase interface 140 that will shift radially outward in a progressive fashion to the steady state liquid/vapor phase interface 142 as the inventory of water 12 is transferred to the evaporator 14, the condenser 18, and the flow loops 22, 27. It should also be appreciated that if the system conditions are such that the interface 142 is located radially outward from the location 118, little, if any, water 12 will be forced through the evaporator 14.

Preferably, as seen in FIG. 2, the flow loops 22, 27 are arranged so that the entire inventory of water 12 in the system drains to the storage volume 84 when the system is not operating, typically by locating all other system components above the RFMD and orienting all conduits to slope toward lower components and/or the RFMD. Preferably, the storage volume 84, is sufficient to store the entire inventory of water 12 in the system and will produce a liquid/vapor interface 144 that is located below the annular intersection surface 88. It should be appreciated that under freezing conditions, the water 12 will not crack the reservoir 34 because the sloping walls defined by the surface 86 allow the water to expand relatively freely.

Preferably, the heating elements 78 are activated prior to rotating the reservoir 34 to assure that all of the water 12 is completely thawed. It should be understood that the heating elements 78 may be of any conventional type, including electric heating coils and heating conduits for circulating a heated fluid.

I claim:

1. A rotating fluid management device for a system using an inventory of working fluid that is subject to freezing when the system is not operating, the rotating fluid management device comprising:

a housing including an inlet port, a first outlet port, and a second outlet port;

a reservoir having a storage volume defined by an upwardly opening, concave surface of revolution centered on a vertical axis;

means for mounting the reservoir to the housing for rotation about the vertical axis;

a return for directing working fluid from said inlet port to said reservoir;

a pitot tube fixed to said housing and extending to a radially outer location in said reservoir for directing liquid phase working fluid from said reservoir to said second outlet port; and a vent located radially inward from said radially outer location for directing gas phase working fluid from said reservoir to said first outlet port.

2. The rotating fluid management device of claim 1 wherein the concave surface of revolution is a hemisphere.

3. The rotating fluid management device of claim 1 wherein the storage volume is of sufficient size to store the entire inventory of working fluid in the system.

4. The rotating fluid management device of claim 1 wherein the pitot tube extends into said storage volume.

5. The rotating fluid management device of claim 1 further comprising heating means on said housing adjacent said storage volume for thawing working fluid stored in said storage volume.

6. A fluid system utilizing an inventory of working fluid that is subject to freezing when the system is not operating; the system comprising:

a rotating fluid management device including a housing including an inlet port, a first outlet port, and a second outlet port, a reservoir mounted on said housing for rotation about an axis, the reservoir including a storage volume sufficient to store the entire inventory of working fluid in the system when the system is not operating, the storage volume defined by a surface that slopes upwardly and outwardly from an area of the surface that is bottommost when the system is not operating, a return for directing working fluid from said inlet port to said reservoir, a pitot tube fixed to said housing and extending to adjacent a radially outer location in said reservoir for directing liquid phase working fluid from said reservoir to said second outlet port, and a vent located radially inward from said radially outer location for directing gas phase working fluid from said reservoir to said first outlet port; and a fluid flow loop connected to at least one of the first and second outlet ports and the inlet port for directing the working fluid through the system; the flow loop arranged so that the inventory of working fluid in the system drains to the storage volume when the system is not operating.

7. The fluid system of claim 6 wherein said axis is a vertical axis and said surface is an upwardly opening, concave surface of revolution centered on said vertical axis.

8. The fluid system of claim 7 wherein said concave surface is a hemisphere.

9. The fluid system of claim 6 wherein said pitot tube extends into said storage volume.

10. The fluid system of claim 6 further comprising heating means on said housing adjacent said storage volume for thawing working fluid stored in said storage volume.

* * * * *